US005803671A

United States Patent [19]

Gray

[11] Patent Number: 5,803,671

[45] Date of Patent: Sep. 8, 1998

[54] HOLLOW BARS AND METHOD OF MANUFACTURE

[76] Inventor: Peter Andrew Gray, 11 Partridge Place, Fig Tree Heights, NSW 2060, Australia

[21] Appl. No.: 351,478

[22] PCT Filed: Sep. 22, 1993

[86] PCT No.: PCT/AU93/00486

§ 371 Date: Dec. 21, 1994

§ 102(e) Date: Dec. 21, 1994

[87] PCT Pub. No.: WO94/07619

PCT Pub. Date: Apr. 14, 1994

[30] Foreign Application Priority Data

Sep. 25, 1992 [AU] Australia ..... PL 4942

[51] Int. Cl.[6] ..... E21D 21/00

[52] U.S. Cl. ..... 405/259.1; 411/385; 411/395; 29/463

[58] Field of Search ..... 405/259.1, 259.2, 405/259.3, 259.4, 259.5; 411/385, 395; 175/323; 25/463 OR, 469.5, 464; 228/173.5, 177

[56] References Cited

U.S. PATENT DOCUMENTS

| | | | |
|---|---|---|---|
| 628,747 | 7/1899 | Boxel | 411/385 X |
| 630,428 | 8/1899 | Wahlert | 411/385 X |
| 919,913 | 4/1909 | Miller | 411/385 X |
| 2,771,746 | 11/1956 | Fischer et al. | 411/385 X |
| 3,193,918 | 7/1965 | Helenbrand | 29/463 |
| 4,092,814 | 6/1978 | Kern | 52/730 |
| 4,498,817 | 2/1985 | Oulsnam | 405/255.1 X |
| 4,630,971 | 12/1986 | Herbst et al. | 405/259.5 |
| 4,946,314 | 8/1990 | Gruber | 405/255.1 X |
| 4,958,961 | 9/1990 | Herbst et al. | 405/255.1 |
| 4,984,937 | 1/1991 | Karaellus | 405/259.1 X |
| 5,433,558 | 7/1995 | Gray | 405/259.1 |

FOREIGN PATENT DOCUMENTS

| | | |
|---|---|---|
| 74446 | 2/1982 | Australia . |
| 45736 | 2/1986 | Australia . |
| 75744 | 1/1988 | Australia . |

OTHER PUBLICATIONS

Derwent Abstract Accession No. 88–328394/46 as it pertains to SU–A–1391753 (Bronfen) 30 Apr. 1988.

Derwent Soviet Inventions Illustrated, Dec. 1972, as it pertains to SU 341619 (Borisov et al) 4 Jul. 1972.

Derwent Abstract Accession No. 07185 as it pertains to SU–A–254452 (Aliev) 7 Sep. 1981.

Derwent Abstract Accession No. 00662 as it pertains to JP–A–6154217 (Matsushita) 28 Nov. 1981.

Patent Abstracts of Japan, M675, p. 156, as it pertains to JP–A–62–220215 (Kawasaki Steel Corp.) 28 Sep. 1987.

Patent Abstracts of Japan, M–94, p. 82 as it pertains to JP–A–56–95440 (Sakamura) 1 Aug. 1981.

*Primary Examiner*—David J Bagnell
*Assistant Examiner*—Frederick I. Lagman
*Attorney, Agent, or Firm*—Kerkam, Stowell, Kondracki & Clarke; Dennis P. Clarke

[57] ABSTRACT

A hollow bar (3) and a method of manufacturing the hollow bar are disclosed. Typically, the hollow bar is a threaded rock bolt or a drill rod. The hollow bar (3) comprises two or more elongate members (21*a*, 21*b*) connected together along the longitudinal edges (41) of the members (21*a*, 21*b*). The method comprises rolling the members (21*a*, 21*b*) and welding or gluing the members (21*a*, 21*b*) together along the longitudinal edges (41) of the members (21*a*, 21*b*).

10 Claims, 2 Drawing Sheets

HOLLOW BARS AND METHOD OF MANUFACTURE

The present invention relates to hollow bars, particularly hollow bars that are suitable for use as rock bolts and drill rods, and to a method of manufacturing hollow bars.

A known method, commonly referred to as the "pierced-billet method", of manufacturing hollow drill rods comprises drilling a billet of steel, typically up to 150 mm in diameter and 1.2 m in length from both ends to form a hole that is approximately 20–30 mm in diameter and inserting a manganese steel mandrel into the hole. The method further comprises heating the billet with the mandrel inside to about 1150° C. and then passing the billet/mandrel through a series of rolls to form the required transverse section (i.e. round, square, hexagonal etc.) and to reduce the external diameter to the required dimensions. The method further comprises allowing the rolled billet/mandrel to cool and removing the mandrel to form the final product of a rolled steel bar having a central hole and the required external profile and dimensions. In order to remove the from the rolled billet/, the is gripped and pulled in tension to reduce its diameter slightly and the mandrel is cut while in tension so that it flies out of the billet.

The method involves several steps and also necessitates the use of a special manganese steel for the mandrel which has to be scrapped after being removed from the rolled steel bar. Consequently, the method is relatively expensive and is not suited to large scale production as would be required for rock bolts.

A known method of manufacturing tubes comprises rolling a long, flat strip of steel into a round shape and then continuously welding the two sides of the strip together to form a tube. In practice, the method is carried out on a continuous basis and the welding is completed very quickly.

The method can produce tubes of different sizes within limits, although it is very difficult to produce a relatively thick walled tube as would be required for rock bolts without the further step of "sinking" the tube through a die to reduce the outside diameter and at the same time to increase the wall thickness. In addition, it is very difficult to roll a profile on the outside of the tube as would be required for rock bolts of the type having an external threaded profile.

It is an object of the present invention to provide a method of manufacturing hollow bars which alleviates the disadvantages of the known methods described in the preceding paragraphs.

According to the present invention, there is provided a method of manufacturing a hollow bar, comprising:

(a) forming two or more elongate members, each of which forms a segment of the hollow bar; and (b) connecting the members together along the longitudinal edges of the members to form the hollow bar.

The term "hollow bar" as used herein is understood to cover any elongate element, such as hollow rock bolts, drill rods, pipes or tubes.

The terms "rock bolt" and "drill rod" as used herein are understood to cover hollow members which have an axial bore or bores and a relatively large wall thickness compared with the bore diameter. Specifically, the terms are understood to cover rock bolts and drill rods which have a maximum bore diameter which is less than or equal to four times the maximum wall thickness.

It is preferred that the method comprises forming two members to form the hollow bar.

It is preferred particularly that the two members be identical.

It is preferred that the step of forming the members comprises rolling or die drawing the members.

In one embodiment, it is preferred particularly that the step of rolling the members forms sections of a threaded profile on each of the members so that the hollow bar formed by connecting the members together comprises a threaded profile and is suitable for use as a threaded rock bolt.

In another embodiment, it is preferred particularly that the step of rolling the members forms a half hexagonal shape on each of the members so that the hollow bar formed by connecting the members together comprises a complete hexagonal profile and is suitable for use as a hexagonal drill rod.

It is preferred that the method comprises connecting the members together by welding or gluing.

It is preferred that the step of connecting the members together comprises feeding the members into a jig, aligning the members, and welding or gluing the members together.

It is preferred that the step of rolling the members forms the longitudinal edges of the members with profiles to maximize the surface area of contact and enable proper alignment when connecting the members together.

It is preferred particularly that the profiles be tongue and groove profiles.

It is preferred that the step of rolling the members forms the longitudinal edges so that when the members are positioned together, the adjacent longitudinal edges define the sides of an outwardly opening channel for receiving weld metal or glue.

According to the present invention, there is also provided a hollow bar comprising two or more elongate members connected together along the longitudinal edges of the members.

It is preferred that there be two members.

It is preferred particularly that the two members be identical.

It is preferred that the longitudinal edges of the members comprise profiles that maximise the surface area of contact between the longitudinal edges of adjacent members and enable proper alignment of the members.

It is preferred particularly that the profiles be tongue and groove profiles.

It is preferred that the members be connected together by welding or gluing.

It is preferred that the longitudinal edges of the members define outwardly opening channels for receiving weld metal or glue.

It is preferred that the hollow bar be suitable for use as a threaded rock bolt or a drill rod.

It is preferred particularly that each member comprises an external profile that defines part-of the threaded profile of the rock bolt or the drill rod.

The present invention is described further by reference to the accompanying drawings in which.

Figure 1:
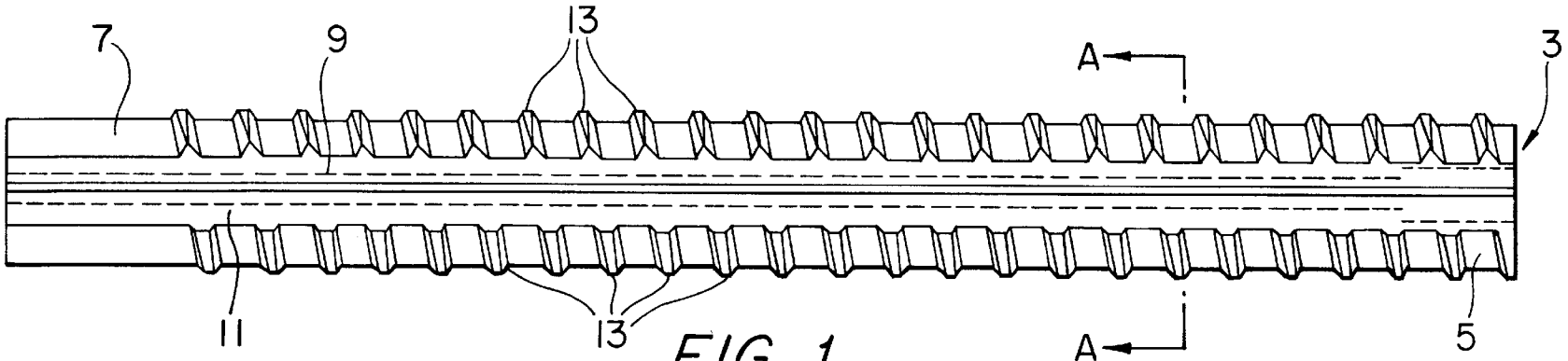
FIG. 1 is a side elevation of a preferred embodiment of a self-tapping rock bolt in accordance with the present invention formed by welding together two identical elongate members.

The rock bolt shown in the figures is of the type disclosed in FIGS. 7 to 9 in the patent specification of International application PCT/AU91/00503 (WO092/08040) in the name of BHP Engineering Pty, Ltd.

The rock bolt 3 comprises:

(a) a leading end 5 for convenient insertion into a pilot hole (not shown);

(b) a trailing end 7;

(c) an axially extending bore 9 (which may be circular or non-circular depending on requirements) to enable water to be pumped through the rock bolt into the pilot hole during insertion of the rock bolt 3;

(d) two diametrically opposed flats 11 extending along the length of the rock bolt 3; and (e) a plurality of thread sections 13 which form a discontinuous threaded profile.

Typically, the rock bolt 3 has a diameter of 15 to 50 mm and a wall thickness of at least 5 mm.

Figure 2:
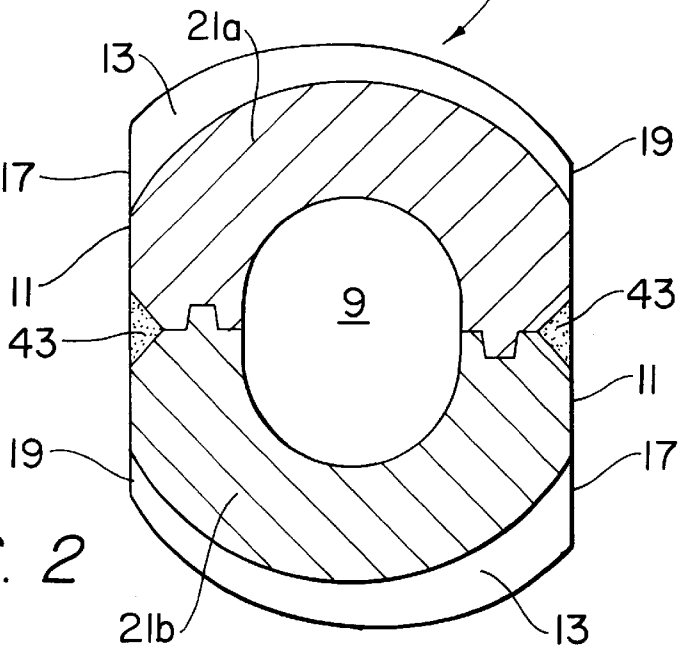
FIG. 2 is a cross-sectional view along the line A—A in FIG. 1 illustrating the cross-sectional profile of a preferred embodiment of the members.
Figure 4:
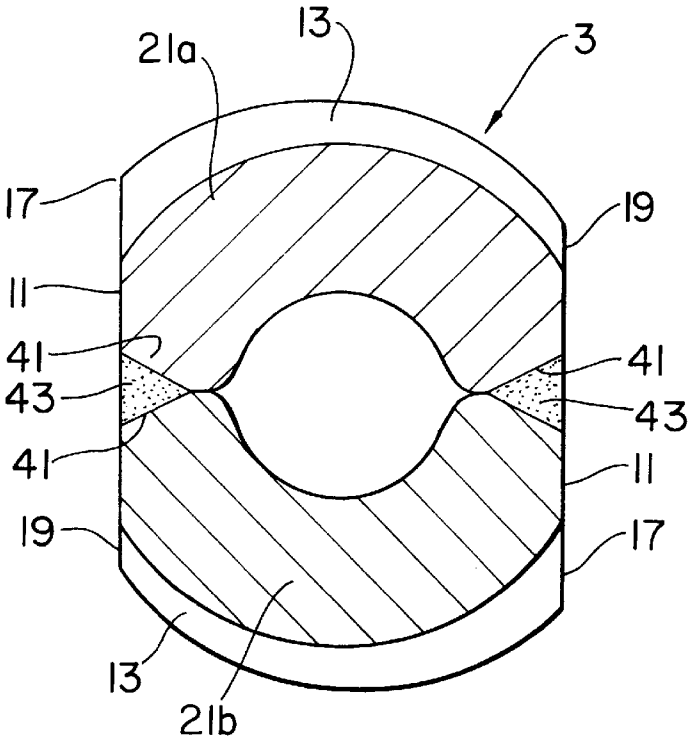
FIG. 4 is a cross-sectional view along the line A—A in FIG. 1 illustrating the cross-sectional profile of another preferred embodiment of the members.

As can best be seen in FIGS. 2 and 4, each thread section 13 extends from a leading edge 17 adjacent to one of the flats 11 to a trailing edge 19 adjacent to the other of the flats 11. The leading edges 17 of the thread sections 13 define cutting edges of the rock bolt 3.

Figure 3:
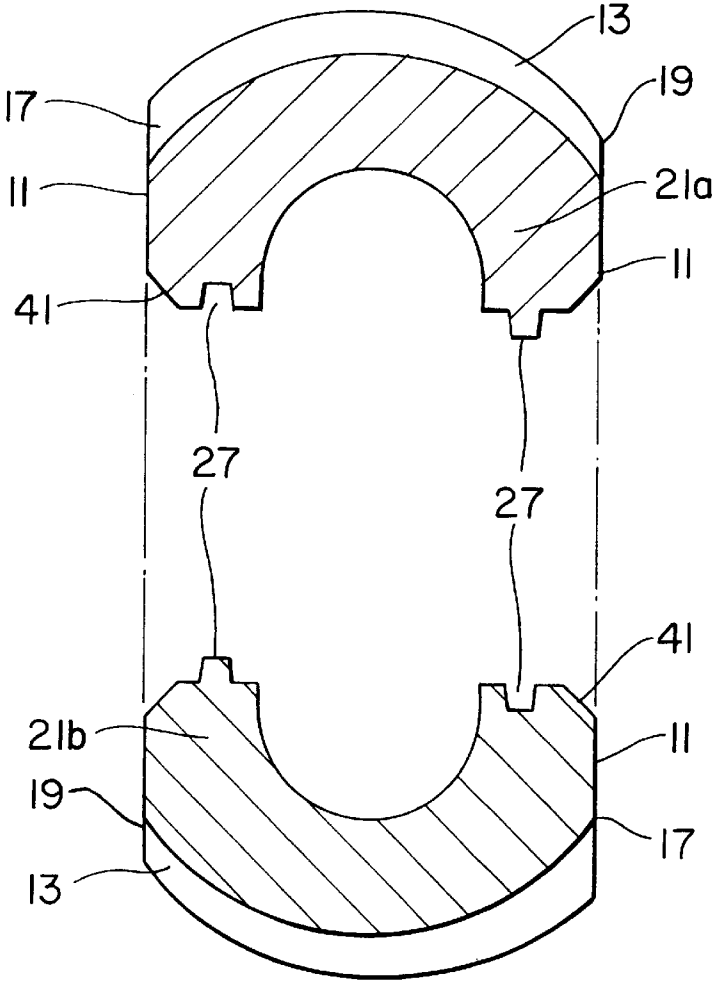
FIG. 3 is a cross-sectional view similar to that shown in FIG. 2 but with the members spaced apart.

The rock bolt 3 is formed by welding together two identical elongate members identified by the numerals 21*a*, 21*b* in FIGS. 2 to 4 along the longitudinal edges 41 of the members 21*a*, 21*b*. The welds are identified by the numerals 43 in FIGS. 2 and 4.

In the preferred embodiment shown in FIGS. 2 and 3, the longitudinal edges 41 of the members 21*a*, 21*b* are formed with tongue and groove profiles 27 in order to maximize the surface area of contact between the longitudinal edges 41 and to enable proper alignment of the members 21*a*, 21*b* prior to welding together the members 21*a*, 21*b*. In addition, the longitudinal edges 41 of the members 21*a*, 21*b* are formed to define outwardly opening V-shaped weld metal channels 43 when the members 21*a*, 21*b* are in contact.

In the preferred embodiment shown in FIG. 4, the longitudinal edges 41 are formed so that there is a relatively small surface area of contact between the longitudinal edges 41 and relatively large (compared with the preferred embodiments shown in FIGS. 2 and 3) outwardly opening V-shaped weld channels 43.

The members 21*a*, 21*b* are formed by rolling in a normal rolling process at high speed. The rolled members 21*a*, 21*b* are fed into a jig and mated together so that the threaded profiles of the members 21*a*, 21*b* are matched and form a discontinuous threaded profile. Finally, the members 21*a*, 21*b* are welded together using high speed robotic welding equipment.

It is noted that in the case of the preferred embodiment shown in FIGS. 2 and 3, the tongue and groove profiles 27 ensure proper alignment of the members 21*a*, 21*b* and in the case of the preferred embodiment shown in FIG. 4, the members 21*a*, 21*b* are aligned by the flats 11 and the threaded profiles.

The rock bolt 3 can be manufactured at significantly lower cost than is possible with the known methods and at large scale production.

Many modifications may be made to the preferred embodiment of the rock bolt 3 and the method of manufacturing the rock bolt 3 without departing from the spirit and scope of the present invention.

In this regard, while the preferred embodiment comprises welding together the elongate members 21*a*, 21*b*, it can readily be appreciated that the present invention is not so limited and extends to any suitable means including the use of adhesives to connect together the members.

Furthermore, while the preferred embodiment of the rock bolt 3 is formed from two identical elongate members 21*a*, 21*b*, it can readily be appreciated that the present invention is not so limited and the rock bolt 3 could be formed from any suitable number of members.

Furthermore, while the preferred embodiment of the rock bolt 3 is formed from steel, it can readily be appreciated that the present invention is not so limited and the rock bolt 3 could be formed from any suitable material.

Furthermore, while the preferred embodiments relate to the rock bolt 3 and the method of manufacturing the rock bolt 3, it can readily be appreciated that the present invention is not so limited and extends to any hollow element, such as drill rods, pipes and tubes.

I claim:

1. A method of manufacturing a rock bolt or a drill rod having an axially extending bore, the method comprising the steps of:

(a) forming by a method selected from the group consisting of rolling and die drawing two or more elongate members, each of which forms a lengthwise extending segment of the rock bolt or the drill rod and comprises an internal wall and an external wall; and (b) connecting the members together along the longitudinal edges thereof by gluing or welding to form the rock bolt or the drill rod with the internal walls of the members defining the axially extending bore.

2. The method defined in claim 1 wherein there are two identical members.

3. The method defined in claim 1, further comprising, rolling or die drawing each member to form on the external wall a section of a threaded profile so that the rock bolt formed by connecting the members together comprises the threaded profile.

4. The method defined in claim 3, wherein the threaded profile is continuous.

5. The method defined in claim 1, wherein the forming step (a) of rolling or die drawing each member forms a half hexagonal shape on the external wall of each of the members so that the drill rod formed by connecting the members together comprises a complete hexagonal external profile.

6. The method defined in claim 1, wherein the step of connecting the members together comprises, feeding the members into a jig, aligning the members, and welding or gluing the members together.

7. The method defined in claim 1, wherein the forming step (a) of rolling or die drawing each member forms the longitudinal edges of the members with profiles to maximize the surface area of contact and enable proper alignment when connecting the members together.

8. The method defined in claim 7, wherein the profiles are tongue and groove profiles.

9. The method defined in claim 1, wherein the forming step (a) of rolling or die drawing each member forms the longitudinal edges so that when the members are positioned together, the adjacent longitudinal edges define the sides of an outwardly opening channel for receiving weld metal or glue to connect the members together.

10. The method defined in claim 1, wherein the rock bolt has a diameter of 15 to 50 mm and a maximum wall thickness of at least 5 mm.

* * * * *

UNITED STATES PATENT AND TRADEMARK OFFICE

CERTIFICATE OF CORRECTION

PATENT NO. : 5,803,671

DATED : September 8, 1998

INVENTOR(S) : Peter Andrew GRAY

It is certified that error appears in the above-identified patent and that said Letters Patent is hereby corrected as shown below:

On the title page in the left-hand column under "[56] References Cited - U.S. PATENT DOCUMENTS" please delete "Boxel" and insert -- Bokel --; delete "Helenbrand" and insert -- Heldenbrand --

On the title page in the right-hand column under "[56] References Cited - U.S. PATENT DOCUMENTS" please delete "Karaellus" and insert -- Karpellus --

Column 4, line 62 (claim 10, line 2): delete "maximum"

Signed and Sealed this

Twenty-third Day of March, 1999

*Attest:*

Q. TODD DICKINSON

*Attesting Officer*

*Acting Commissioner of Patents and Trademarks*